US008545041B2

(12) United States Patent
Brown

(10) Patent No.: US 8,545,041 B2
(45) Date of Patent: Oct. 1, 2013

(54) MOUNTING CLIP

(75) Inventor: Kenneth J. Brown, Glenmoore, PA (US)

(73) Assignee: MSB Incorporated, Glenmoore, PA (US)

( * ) Notice: Subject to any disclaimer, the term of this patent is extended or adjusted under 35 U.S.C. 154(b) by 423 days.

(21) Appl. No.: 12/763,269

(22) Filed: Apr. 20, 2010

(65) Prior Publication Data

US 2010/0254123 A1 Oct. 7, 2010

Related U.S. Application Data

(63) Continuation-in-part of application No. 11/754,443, filed on May 29, 2007, now Pat. No. 7,703,938, and a continuation-in-part of application No. 11/311,296, filed on Dec. 19, 2005, now abandoned.

(60) Provisional application No. 60/636,905, filed on Dec. 18, 2004.

(51) Int. Cl.
*F21V 21/088* (2006.01)

(52) U.S. Cl.
USPC ..... 362/191; 362/106; 362/396; 24/336

(58) Field of Classification Search
USPC ..... 362/184, 190, 191, 396, 249.01, 362/249.14; 248/316.7, 231.81, 229.16, 248/229.26, 231.85; 24/336, 3.12
See application file for complete search history.

(56) References Cited

U.S. PATENT DOCUMENTS

| | | | | |
|---|---|---|---|---|
| 1,858,284 | A | 5/1932 | Schwartz | |
| 2,402,877 | A | 6/1946 | Dial | |
| 4,390,927 | A | 6/1983 | Von Feldt | |
| 4,406,040 | A | 9/1983 | Cannone | |
| D281,393 | S | 11/1985 | Karnhag et al. | |
| 5,103,384 | A | 4/1992 | Drohan | |
| 5,199,780 | A | 4/1993 | Ekman | |
| 5,683,171 | A | 11/1997 | Van Gennep | |
| 5,690,416 | A | 11/1997 | Van Gennep | |
| 5,772,166 | A * | 6/1998 | Adams | 248/231.81 |
| D401,005 | S | 11/1998 | Ludbrook et al. | |
| 5,867,874 | A * | 2/1999 | Simpson | 24/336 |
| 6,206,543 | B1 | 3/2001 | Henry | |
| D464,750 | S | 10/2002 | Cooper | |
| 7,040,783 | B1 | 5/2006 | Christianson | |
| 7,055,979 | B2 | 6/2006 | Lee | |
| 7,168,821 | B2 | 1/2007 | Huang | |
| 2005/0254238 | A1 | 11/2005 | Parker et al. | |

* cited by examiner

*Primary Examiner* — Thomas Sember
(74) *Attorney, Agent, or Firm* — Allen, Dyer, Doppelt, Milbrath & Gilchrist, P.A.

(57) ABSTRACT

A mounting clip for attaching objects, such as flashlights to an article, such as a hat or belt, includes a clip portion dimensioned for attaching the clip to the article and an object mounting portion formed with the clip portion. Objects of different widths are removably yet snugly grasped within the object mounting portion. The clip portion includes upper and lower members defining a slot for receiving the article through a lip of the slot and frictionally securing the clip to the article.

14 Claims, 12 Drawing Sheets

MOUNTING CLIP

CROSS-REFERENCE TO RELATED APPLICATIONS

This application is a continuation-in-part of U.S. patent application Ser. No. 11/754,443, filed on May 29, 2007, now U.S. Pat. No. 7,703,938 which is a continuation-in-part of U.S. patent application Ser. No. 11/311,296, filed on Dec. 19, 2005, entitled "Flashlight Hat Clip", which claims priority to U.S. Provisional Application No. 60/636,905, filed Dec. 18, 2004 the disclosures of which are hereby incorporated by reference herein in their entireties, and all commonly owned.

FIELD OF THE INVENTION

This invention relates to an accessory for use in mounting lighting devices to headwear and, more particularly, to a mounting clip that can be detachably mounted on the bill of a cap to mount temporarily a flashlight thereto.

BACKGROUND OF THE INVENTION

Flashlights have long been popular as portable light sources and can provide a lightweight, compact package for casting a beam of light. More modern flashlight configurations utilize a light emitting diode that provides a strong light beam from relatively small batteries carried in the flashlight casing. Generally, these mini-flashlights are not self-supporting. Thus, it is typically necessary for a user of these mini-flashlights to use one hand to hold and position the light beam emanating from the flashlight, which can be a hindrance if the user is trying to accomplish a task that requires the use of more than one hand.

The placement of a flashlight into a mounting apparatus for support on headwear is known, as illustrated by way of example with reference to U.S. Pat. No. 5,199,780, wherein a flashlight hat clip is arranged to be mounted on the headband of the hat to support a flashlight to be carried by the hat while being worn. In U.S. Pat. No. 4,406,040, a lighting apparatus is affixed to a mounting clip that can be affixed to the front bill of a cap and adjustable to be pointed downwardly in front of the user of the apparatus. A spring clip having a lighting device integrally formed therewith for mounting on the front of the bill of a cap is disclosed in U.S. Design Pat. No. D464,750.

However, none of the above-identified teachings provide a device that is adapted for use with multiple mini-flashlight sizes and may be positioned on the side of the bill of a cap, by way of example, so that the weight of the device is not pulling down on the cap and making the cap difficult to remain in place. Accordingly, it would be desirable to provide a mounting clip that is independent of the flashlight and that can be mounted to the bill of a cap along the side of the head to direct a beam of light forwardly of the user to free the use of both hands of the user for other activities. It would further be desirable to provide a mounting clip that can be used with multiple sizes of mini-flashlights.

SUMMARY

The invention overcomes the disadvantages of the prior art by providing a clip having a clip portion dimensioned for removably attaching to an article and an object mounting portion formed with the clip portion. Means is provided with the object mounting portion for removably and snugly grasping objects of different width dimensions within the object mounting portion.

The clip portion may be oriented in a first direction and the object mounting portion is oriented so that an object having an elongate portion has the elongate portion extending generally orthogonally with respect to the first direction when the object is carried by the object mounting portion. The grasping means may comprise opposing segments of the object mounting portion biased toward each other so as to exert a gripping force on an object carried therebetween. The biasing may result from the clip being formed of a memory retentive material. Optionally, the opposing segments may be dimensioned to form an opening therebetween, wherein at least one of the opposing segments can flex sufficiently away from the other to expand the size of the opening for permitting the object to enter the grasping through the expanded opening.

Embodiments may provide a mounting clip to support flashlights of differing diameters, by way of example. One feature in an embodiment of the invention that the mounting portion is formed with arcuate segments that when taken together form a generally circular barrel grasping portion for engaging the barrel of a flashlight placed therein.

A feature of an embodiment of the invention may comprise the mounting portion formed with two barrel grasping portions having different diameters corresponding to two known sizes of flashlights, by way of example. It is an advantage of this invention that the mounting clip will be operable with most current commercially available flashlights. The clip portion and the mounting portion may be formed with spring-biased members that operate to firmly grasp the bill of the cap and the barrel of the flashlight, respectively. As a result, objects, such as flashlights, may will be stably supported on a bill of a cap, a belt worn by a user, and the like, for a hands free operation within a lighted environment. The clip portion may be formed with a different width dimension than the mounting portion. It is anticipated that material forming the clip will be durable in construction, inexpensive of manufacture, carefree of maintenance, facile in assemblage, and simple and effective in use.

One embodiment if the invention may be constructed with a clip portion and an integral flashlight mounting portion, both of which are made of memory retentive plastic so that the mounting of either portion takes advantage of the spring bias to exert a firm grip on the surface the portion engages. The upper and lower portions of the flashlight mounting portion are formed in a pair of arcuate segments that when taken together form a generally circular barrel grasping portion in two different diameters corresponding to known configurations of mini-flashlights. The surface of the mounting clip can be coated with a rubber-like material that enhances the grip on the surface engaged thereby. The clip portion may be formed with a different width dimension than the flashlight mounting portion.

BRIEF DESCRIPTION OF THE DRAWINGS

The advantages of this invention will become apparent upon consideration of the following detailed disclosure of the invention, especially when taken in conjunction with the accompanying drawings wherein:

FIGS. 3 and 3A are diagrammatical perspective and side views, respectively, illustrating a second embodiment of the invention, wherein FIG. 3A illustrates a movement of components being shown in dashed lines;

DETAILED DESCRIPTION OF EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, the embodiments herein presented are provided so that this disclosure will be thorough and complete, and will fully convey the scope of the invention to those skilled in the art.

Figure 1:
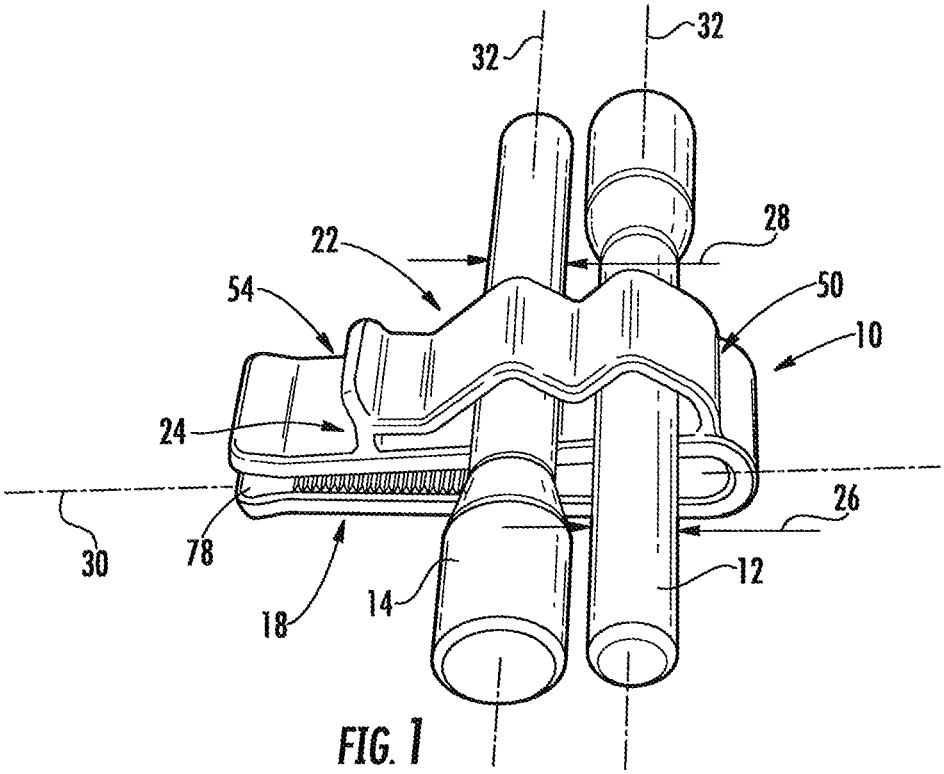
FIGS. 1 and 1A are perspective views of one embodiment of the invention illustrating its use in carrying flashlights, by way of example.
Figure 1A:
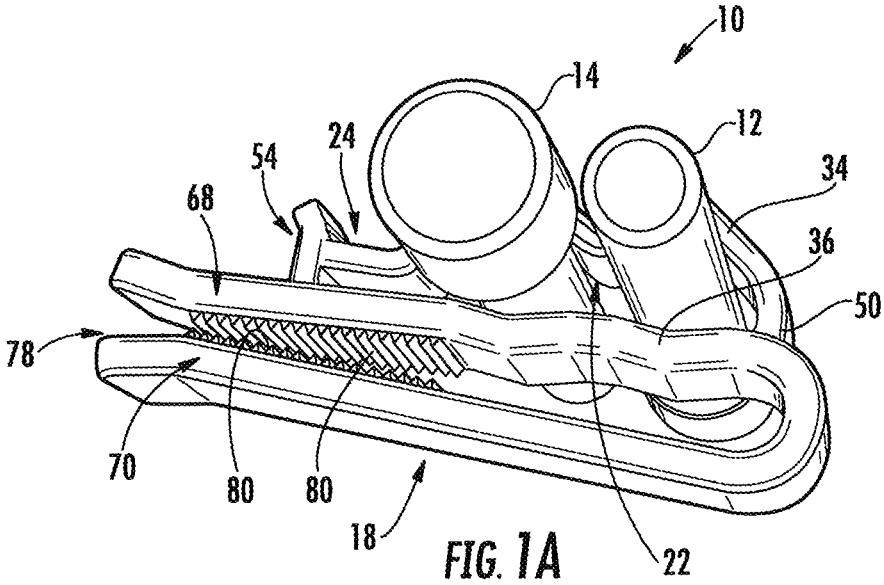
Figure 2:
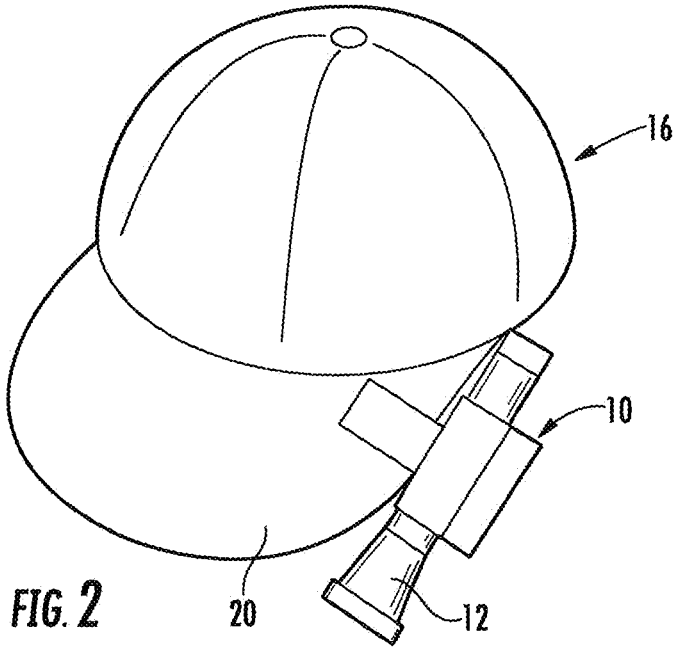
FIGS. 2 and 2A are perspective and front views, respectively, of a representative cap having illustrating a use for embodiments of the invention.

With reference initially to FIGS. 1, 1A and 2, one embodiment of the invention is herein described as a clip 10 for attaching objects 12, 14 to an article 16. With continued reference to FIGS. 1 and 2, and to FIGS. 3, 3A and 3B, embodiments of the clip 10 comprise a clip portion 18 dimensioned for removably attaching to the article 16, such as a visor or bill 20 of the article 16, herein a cap by way of example. An object mounting portion 22 is formed with the clip portion 18 and grasping means 24 is formed with the object mounting portion 22 for removably and snugly grasping the objects 12, 14 of different width dimensions 26, 28 within the object mounting portion.

Figure 3:
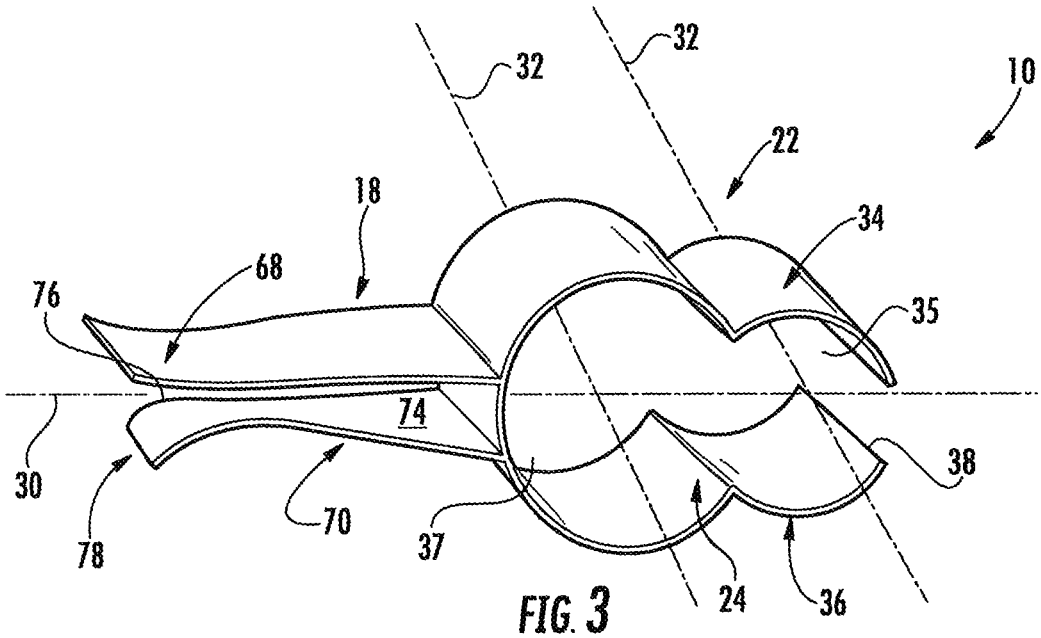

With continued reference to FIGS. 1 and 3, by way of example, the clip portion 18 is oriented in a first direction 30 and the object mounting portion 22 is oriented so that the object has its elongate axis 32 extending generally orthogonally with respect to the first direction when the object is carried by the object mounting portion 22. The grasping means 24 comprises opposing segments 34, 36 biased toward each other so as to exert a gripping force on the objects 12, 14 carried therebetween.

Figure 3A:
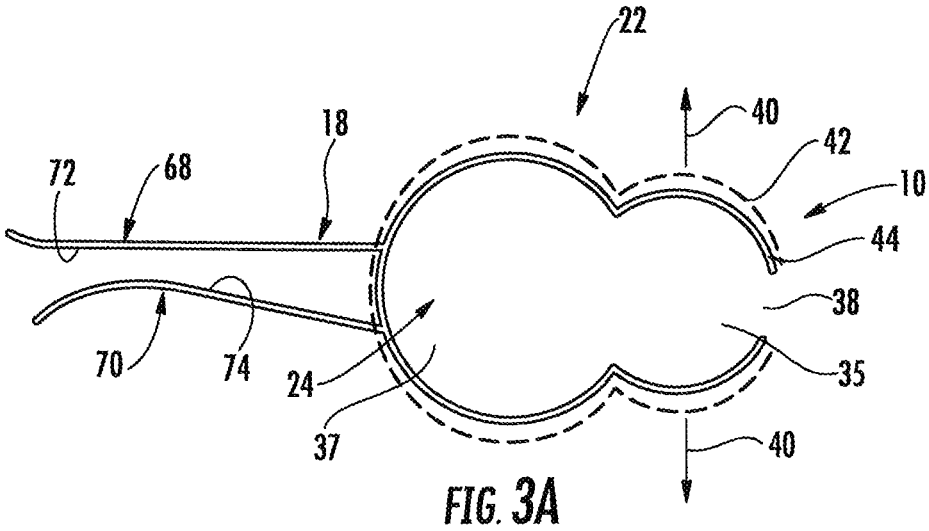
Figure 4:
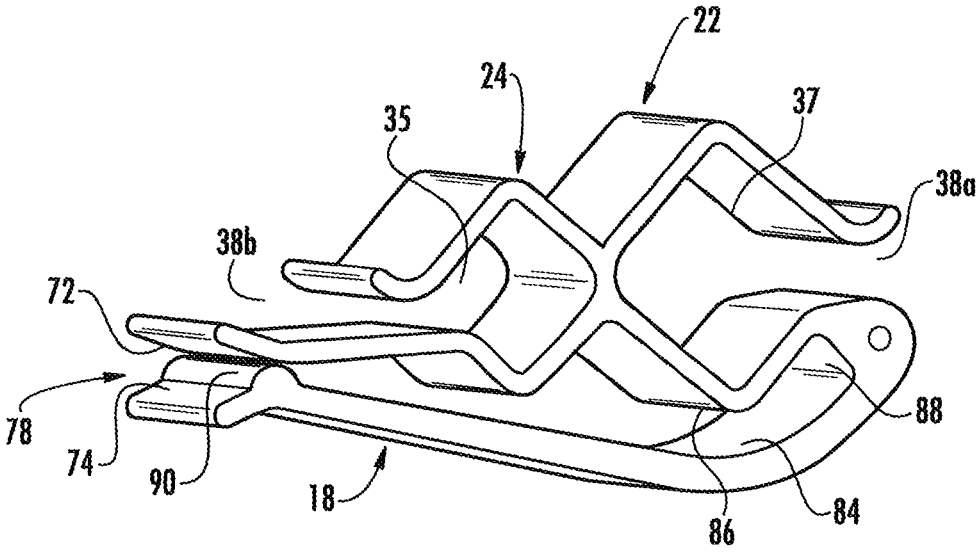
FIGS. 4 and 4A are perspective and side views, respectively, of a third embodiment in keeping with the teachings of the present invention.
Figure 4A:
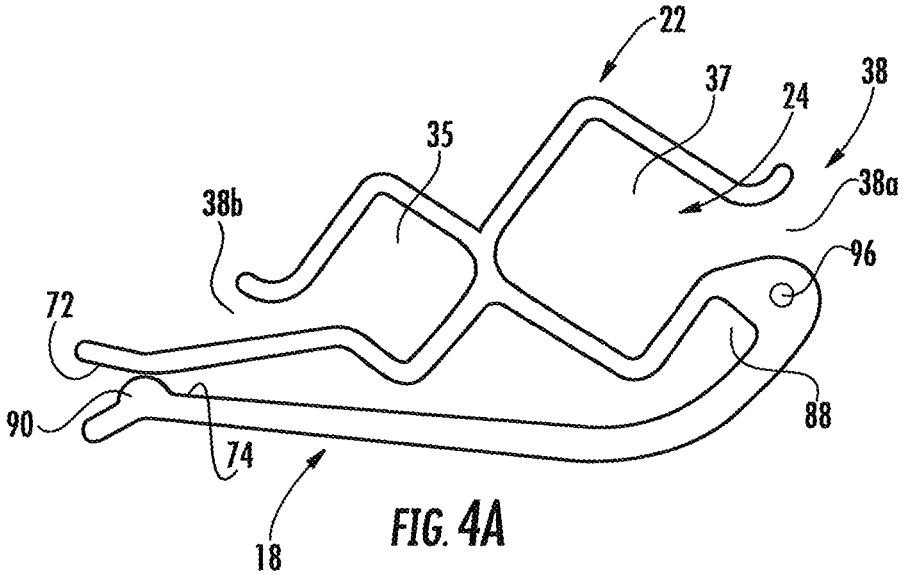

With continued reference to FIG. 3 and now to the embodiment of FIGS. 4 and 4A, the opposing segments 34, 36 are dimensioned to form an opening 38 therebetween, wherein at least one of the opposing segments can flex, illustrated by arrows 40 in FIG. 3A, sufficiently away from the other to expand the size of the opening 38 for permitting the objects 12, 14 to enter the grasping means 24 through an expanded opening.

As will herein be described by way of example for embodiments of selected embodiments of the invention, the opposing segments 34, 36 may each include at least two segment portions 35, 37 having different dimensions 26*a*, 28*a* corresponding to the respective dimensions 26, 28 of the different objects 12, 14. As herein illustrated by way of example only, the different objects 12, 14 include first and second flashlights 12*a*, 14*a*, wherein the first flashlight comprises the first width dimension 26 greater than the second width dimension 28 of the second flashlight, the width dimensions herein being diameters, but may include girth by way of example.

Figure 5:
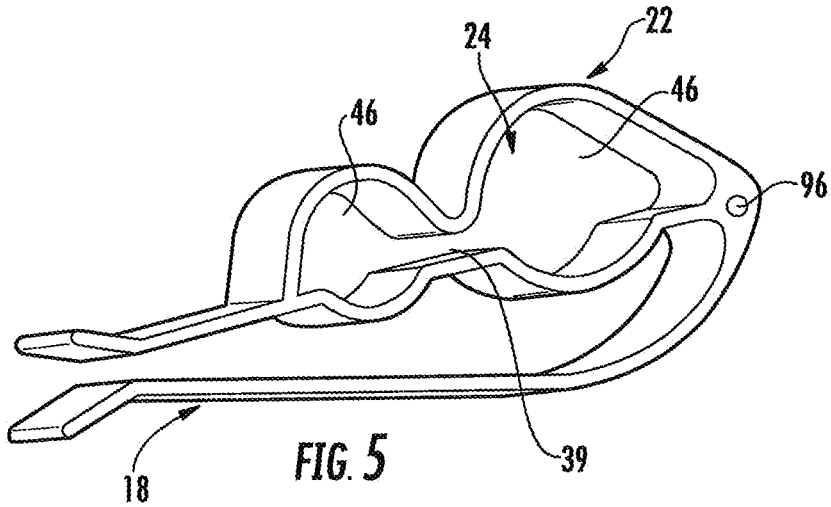
FIGS. 5 and 5A are perspective and side views, respectively, of a fourth embodiment in keeping with the teachings of the present invention, wherein dimensional variations may be employed.
Figure 5A:
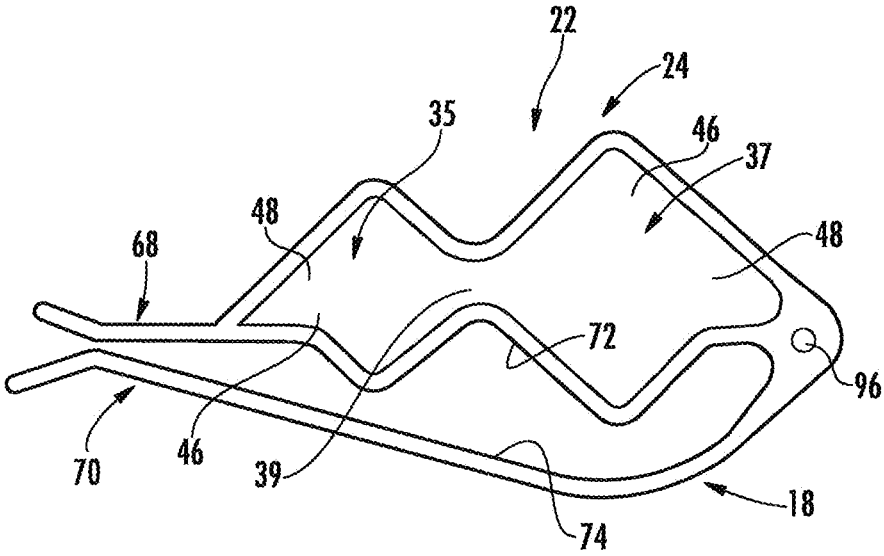
Figure 6:
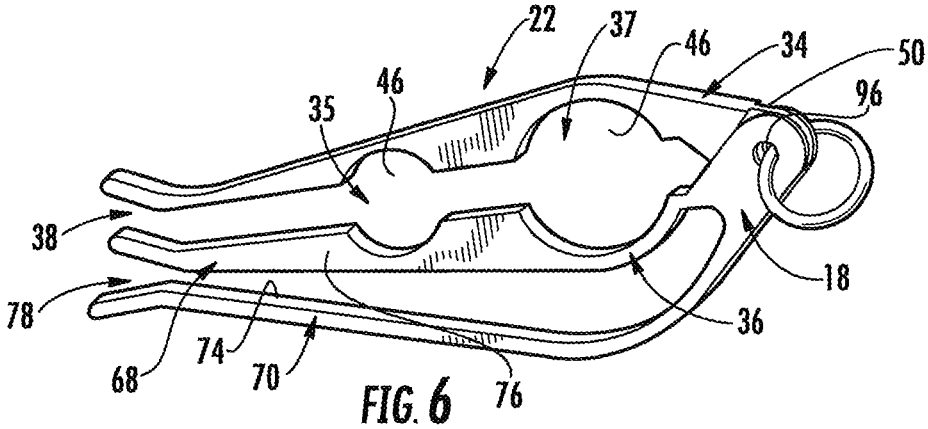
FIG. 6 is a perspective view of a fifth embodiment in keeping with the teachings of the present invention.
Figure 7:
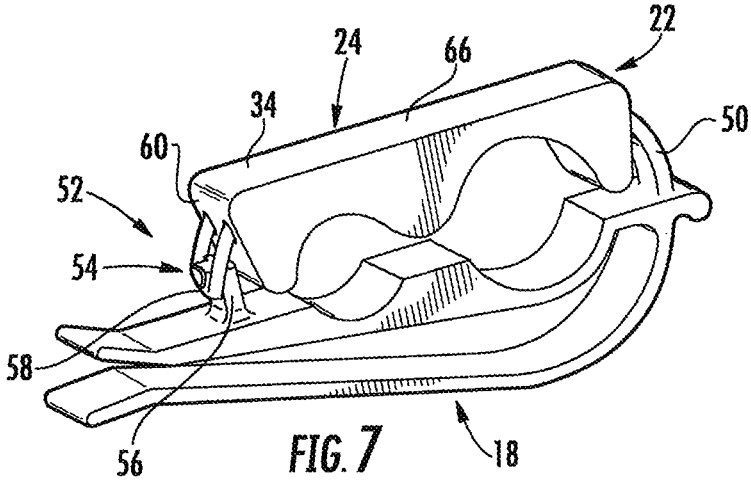
FIGS. 7, 7A and 7B are perspective views of a sixth embodiment in keeping with the teachings of the present invention.
Figure 7A:
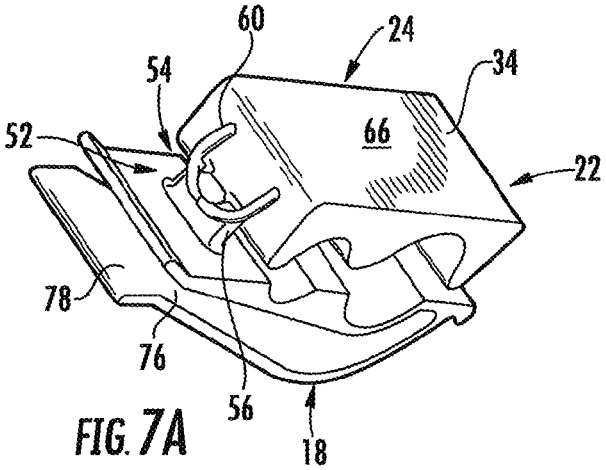
Figure 7B:
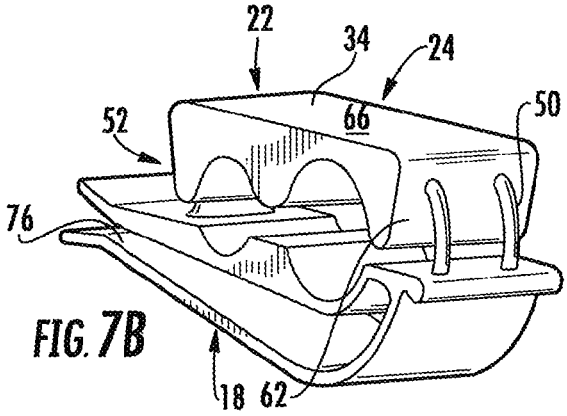
Figure 8:
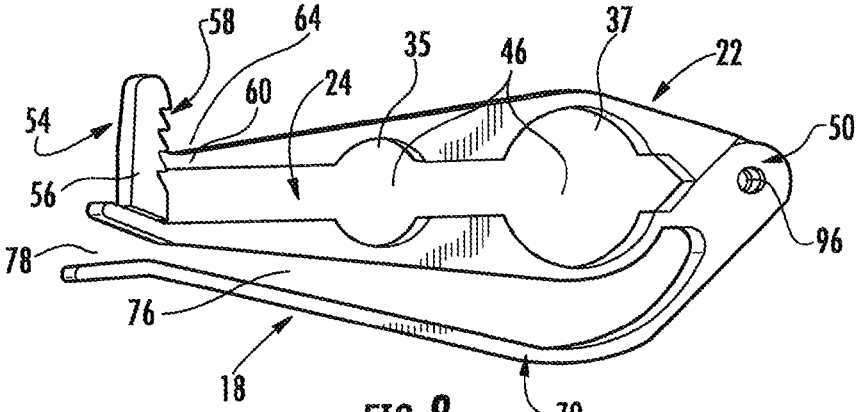
FIG. 8 is a perspective side view of a seventh embodiment in keeping with the teachings of the present invention.

By way of further example with continued reference to FIG. 3, and now to FIGS. 5, 5A and 6, embodiments of the invention may comprise the clip 10 having each of the segment portions 35, 37 including grasping means 24 having a circular aperture 46, or alternatively a rectangular shaped aperture 48, as illustrated with again to FIG. 1 and to FIGS. 4, and 5. As above described with reference to FIG. 3, each of the segments 34, 36 may include the one opening 38 for entering the grasping portion 24, or two openings 38*a*, 38*b*, as illustrated with reference again to FIG. 4. As illustrated with continued reference to FIGS. 3 and 6, the single opening 38 provides access to each of the segment portions 35, 37. Yet further, there is an opening 39 between the segment portions 35, 37, as illustrated with reference again to FIGS. 5 and 5A.

By way of further example, and as illustrated with reference to FIGS. 7, 7A, 7B and 8, one embodiment of the clip 10 includes the object mounting portion having a hinge 50 attached to the clip portion 18 for providing movement of the object mounting portion 22 from an open position, wherein an object may be inserted therein, to a closed position 52, wherein the object is secured therein. A lock 54 secures the object mounting portion 22 in the closed position 52. In the embodiment illustrated with continued reference to FIGS. 7 and 8, the lock 54 comprises an arm 56 having a flanged portion 58 for receiving a distal end 60 of the first segment 34 of the object mounting portion 22. A proximal end 62 of the first segment 34 carries the hinge 50. Alternatively, as illustrated with reference again to FIG. 8, the flanged portion 58 includes a ratcheted surface 64 for receiving the distal end 60, the ratcheting surface providing for a preselected sizing of the grasping portion. With reference again to FIG. 7, the first segment 34 of the object mounting portion 22 may include a generally flat outer surface 66 opposing the grasping portion of the grasping portion 24. As illustrated with reference again to FIGS. 6 and 8, by way of example, the first segment 34 may be hinged 50 with the opposing second segment 36 or clip portion 18, wherein the hinge comprises a spring loading for biasing the segments 34, 36 against each other.

As illustrated with reference again to FIG. 3, by way of example for each embodiment herein described, the clip portion 18 is herein described as including an upper member 68 and a lower member 70 having opposing surfaces 72, 74 defining a slot 76 therebetween for receiving the article 16, as illustrated with reference again to FIG. 2, through a lip 78 of the slot and frictionally securing the article in the slot.

Embodiments of the invention include the upper member 68 of the clip portion 18 forming at least part of the second segment 36 of the object mounting portion 22, as illustrated with reference again to FIGS. 1 and 4-8. As illustrated now to FIGS. 9, 9A and 9B by way of example, the opposing surfaces 72, 74 may comprise serrated surface portions 80. Yet further as described with continued reference to FIG. 9, the opposing surfaces 72, 74 comprise arcuate portions 82, wherein the arcuate portions may comprises the serrations 80. Yet further, the arcuate portions 82 may the opposing surfaces 72, 74 having a convex surface 84 opposing a concave surface 86.

Figure 9:
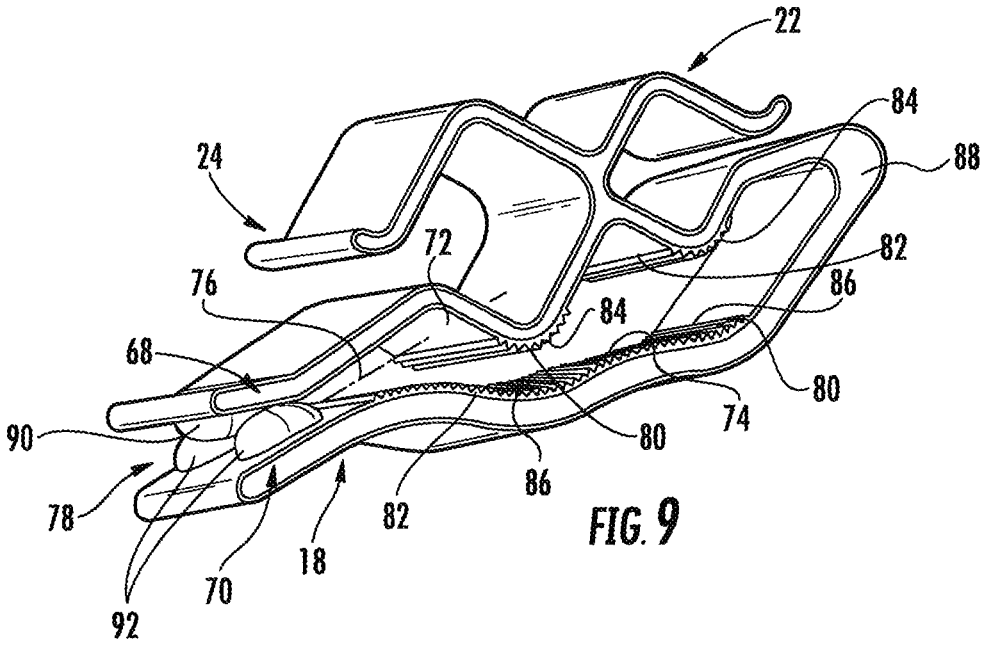
FIGS. 9, 9A and 9B are perspective, side and front views, respectively, of an eighth embodiment in keeping with the teachings of the present invention.
Figure 9A:
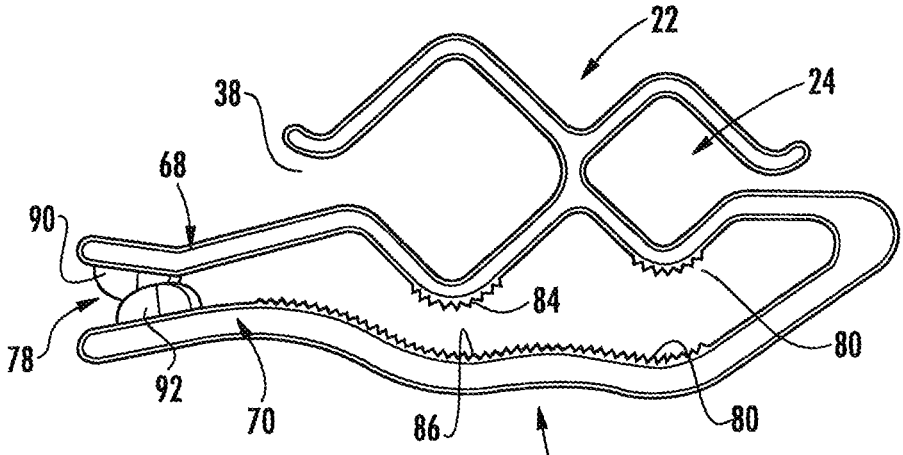
Figure 9B:
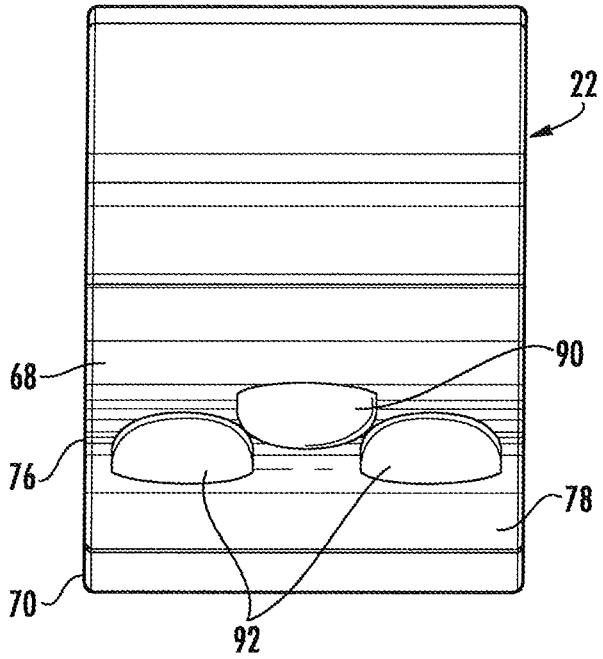
Figure 9C:
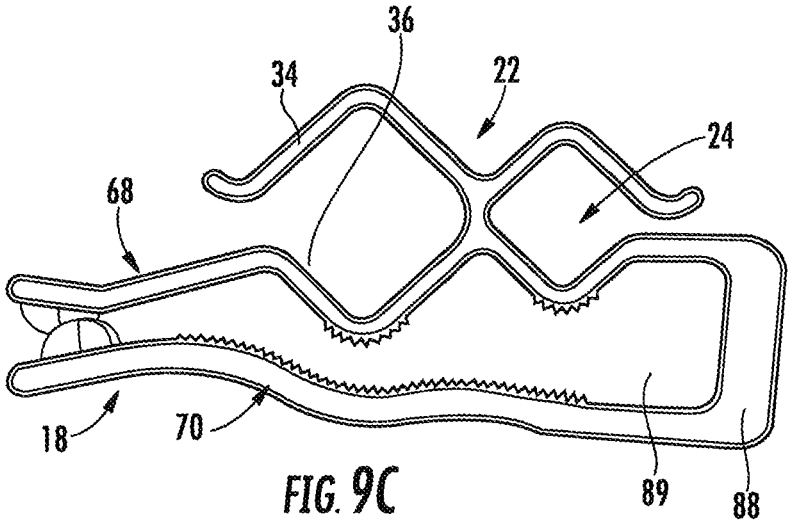
FIG. 9C is a side view of the embodiment of FIG. 9, illustrating a dimensional variation thereof.

With continued reference to FIG. 9, by way of example, the upper and lower members 68, 70 are generally hinged by a portion 88 extending generally orthogonal thereto. As illustrated with reference to FIG. 9C, an area 89 proximate the hinged portion 88 may be enlarged to accommodate a structure of the article to which the clip 10 will be attached. By way of example, attaching the clip to a soft pliable structure will allow a portion of the article to gather within the area 89 permitting an enhanced attachment.

By way of example with reference again to FIGS. 4 and 9, the upper and lower members 68, 70 comprise the lip 78, wherein the lip is flared for increasing an entrance dimension to the slot 76. At least one protuberance 90 extends from at least one of the opposing surfaces 74, as illustrated with reference to FIG. 4, wherein the protuberance is proximate the lip 78. Yet further, embodiments may comprise the protuberance 90 on one of the opposing surfaces 72, 74 and two protuberances 92 on the other opposing surface for cooperating therewith so as to enhance a frictional contact with the article secured therebetween.

Figure 10:
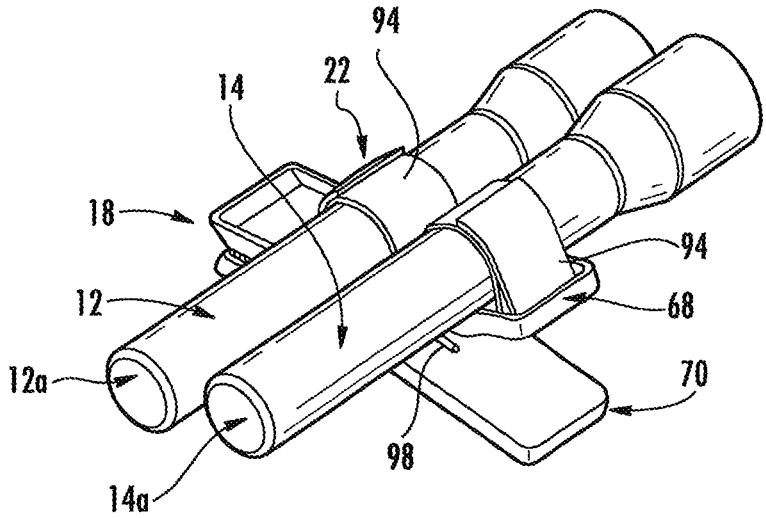
FIGS. 10, 10A and 10B are top, side and bottom perspective views, respectively, of a ninth embodiment in keeping with the teachings of the present invention.
Figure 10A:
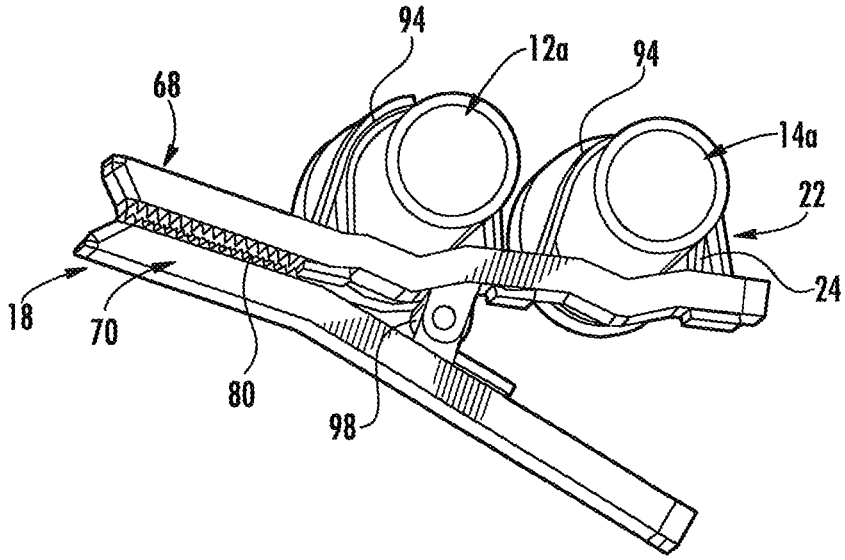
Figure 10B:
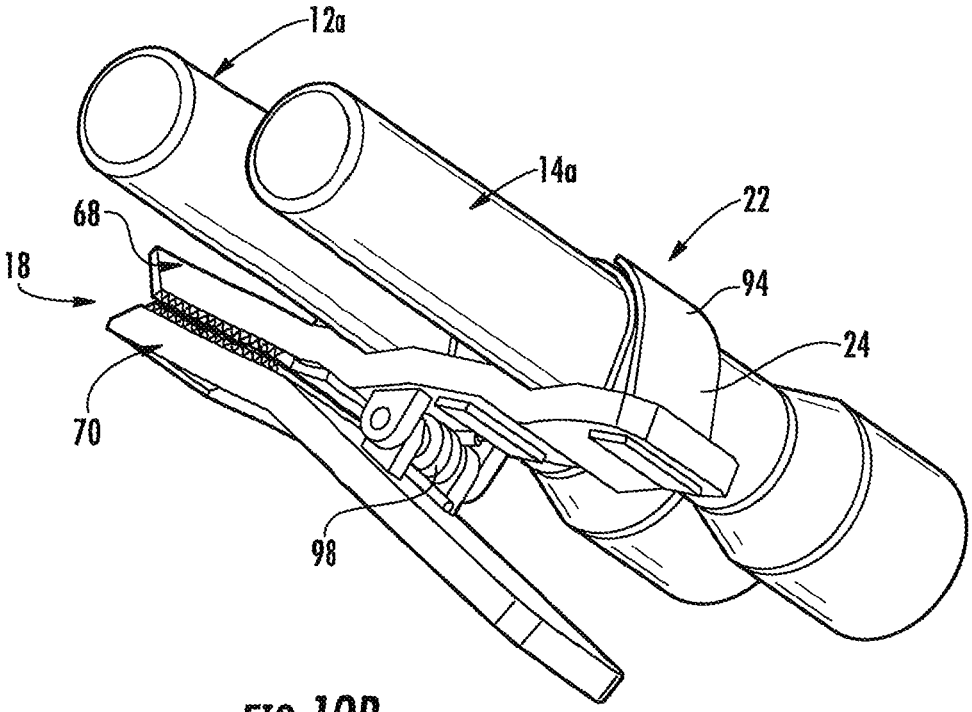

As illustrated with reference to FIGS. 10, 10A and 10B the grasping means or grasping portion 24 may comprise a strap 94 for removably and snugly grasping the objects within the strap.

Yet further, and with reference again to FIGS. 4 and 5, by way of example, embodiments include the clip 10 having hole 96 for passing a line therethrough.

Generally, the clip 10 is formed of a plastic, although other materials, such as nylon, steel and other durable materials could be used as well. Furthermore, the configuration of the clip 10 is particularly adapted to being formed by injection molding. The opposing surfaces 72, 74 of clip portion 18 may be covered with a rubber-like or soft plastic coating to enhance the gripping of the clip portion onto the article 16. As above described, the first and second segments 34, 36 are memory-retentive in that when flexed out of their home position 42, as depicted in dashed lines in FIG. 3A, have an inherent spring bias to return to their home position 44. This spring bias causes the clip portion 18 to grip the bill B of the cap tightly. In an embodiment of the clip portion 18 that is not memory retentive, a spring mechanism 98 is placed into engagement between the upper and lower members 68, 70 to urge the members toward one another, as illustrated with reference to FIG. 10, providing sufficient grip strength for the clip portion. The mounting portion 22 is also formed from a memory retentive polymeric material so that the mounting portion will firmly grasp the object 12 and prevent the object, such as the flashlight 12*a* from moving relative to the mounting portion. To this end, the mounting portion 22 may also be coated with a rubber-like or soft plastic material to increase friction on appropriate surfaces grasping.

Again, the first and second segments 34, 36 are able to flex, as is depicted in FIG. 3, to permit the opening 38 to receive the objects 12, 14, such as the flashlights, the memory retentive upper and lower segments then returning to the home position 44 to firmly grasp the flashlight and retain the flashlight in engagement with the clip 10.

By way of example for embodiments holding the flashlights, one of ordinary skill in the art will note that the size of the clip portion in the first embodiment of the clip is substantially the same width as the mounting portion. This width, being the transverse dimension, is preferably between about one-half inch and about three inches. Such an embodiment would have this width dimension at about three-quarters of an inch, which would change the relative appearance of the mounting clip, in that the width (the transverse dimension would be substantially smaller than the length.

Figure 2A:
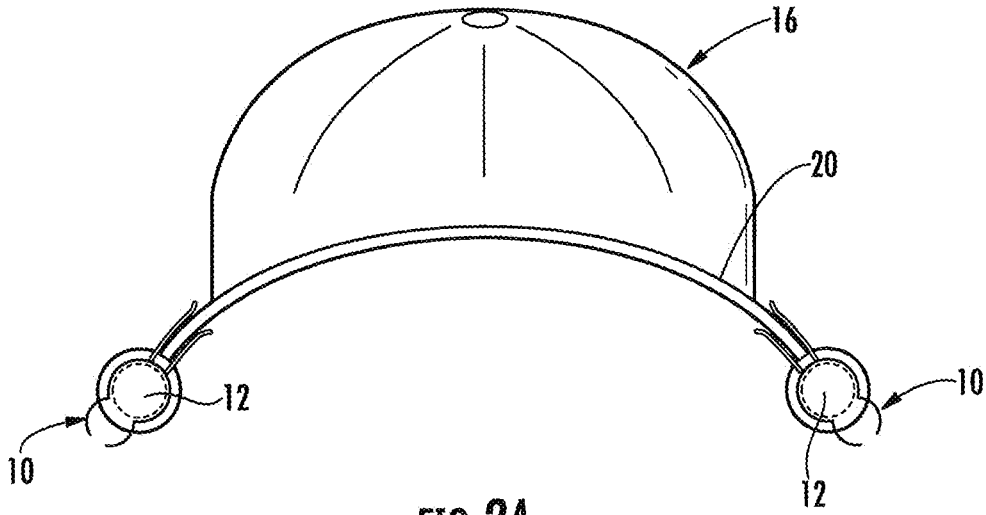
Figure 3B:
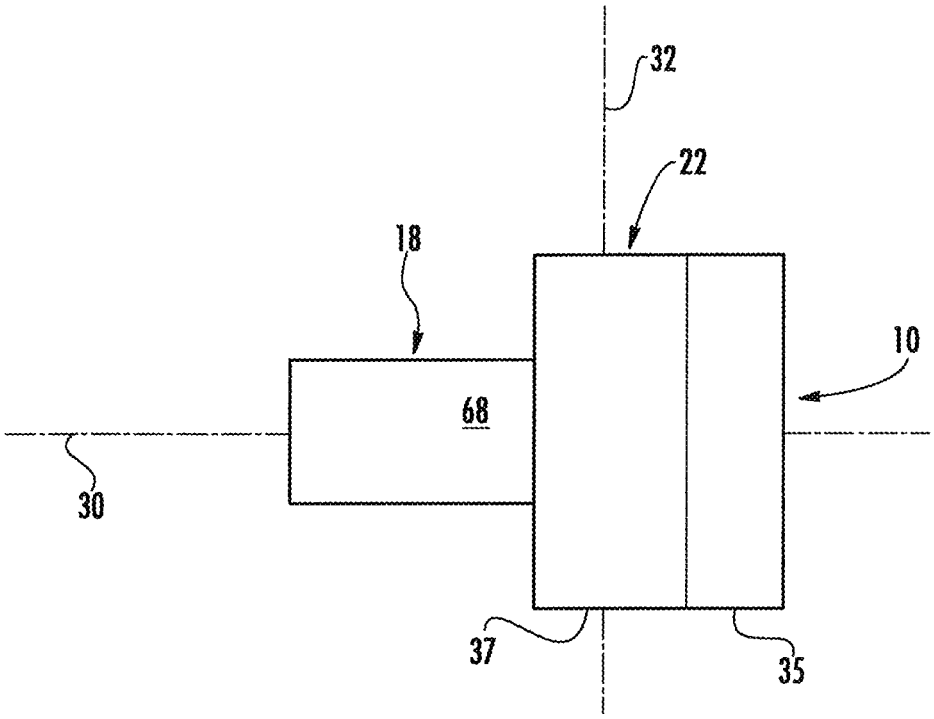
FIG. 3B is top diagrammatical view of the embodiment of FIG. 3 illustrating an alternate component dimension, by way of example.

As illustrated with reference to FIG. 3B, the clip portion 18 is not required to have the same width dimension as the mounting portion 22. In this embodiment of the invention, the relative widths of these two components 18, 22 of the clip 10 are in the range of about three-quarters of an inch for the clip portion and about two inches for the mounting portion. The larger width for the mounting portion can provide enhanced engagement between the segments 34, 36 and the flashlight 12*a*, by way of example. The bill on the front of the cap is illustrated by way of example only. In use, it is expected that the flashlight will be placed into the mounting portion by spreading the segments apart to slide the flashlight through the opening to allow the barrel of the flashlight to be positioned within the grasping portion. Alternative methods will come to mind for the alternate embodiments herein described. As illustrated with reference to FIG. 2A, a pair of clips could be placed with one on either side of the bill. Accordingly, the use of the clip to mount a flashlight or flashlights on the bill of the cap, a belt worn by a user, or the like, allows for deployment of the flashlight aligned generally with the eyes of the user without requiring either of the user's hands to be utilized to manipulate the flashlight.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the claims herein presented.

That which is claimed is:

1. A clip for attaching objects to an article, the clip comprising:

a clip portion dimensioned for removably attaching to an article;

an object mounting portion formed with the clip portion;

means with the object mounting portion for removably and snugly grasping objects of different width dimensions within the object mounting portion;

wherein the clip portion comprises an upper member and a lower member having opposing surfaces defining a slot therebetween for receiving the article through a lip portion of the slot and frictionally securing the article therein, and wherein one segment of the grasping means comprises at least a portion of the upper member of the clip portion, wherein the grasping means comprises opposing segments of the object mounting portion biased toward each other so as to exert a gripping force on an object carried therebetween, wherein each of the at least two segments comprises an opening for entering the grasping portion therethrough, wherein the opposing segments include at least two segment portions having different dimensions corresponding to respective dimensions of different objects.

2. The clip recited in claim 1, wherein the clip portion is oriented in a first direction and the object mounting portion is oriented so that an object having an elongate portion has the elongate portion extending generally orthogonally with respect to the first direction when the object is carried by the object mounting portion.

3. The clip recited in claim 1, wherein the opposing segments are dimensioned to form an opening therebetween, and wherein at least one of the opposing segments can flex sufficiently away from the other to expand the size of the opening for permitting the object to enter the grasping means through the expanded opening.

4. The clip recited in claim 1, wherein the different objects comprise first and second flashlights, and wherein the first flashlight comprises a first diameter greater than a second diameter of the second flashlight.

5. The clip recited in claim 1, wherein each of the at least two segments comprises grasping portions having a rectangular cross section.

6. The clip recited in claim 1, wherein at least one of the opposing surfaces comprises a serrated surface portion.

7. The clip recited in claim 1, wherein at least one of the opposing surfaces comprises at least one arcuate portion.

8. The clip recited in claim 1, wherein the at least one arcuate portion comprises serrations.

9. The clip recited in claim 1, wherein the opposing surfaces comprise a convex surface opposing a concave surface.

10. The clip according to claim 1, wherein the upper and lower members are generally hinged by a portion extending generally orthogonal thereto.

11. The clip recited in claim 1, wherein at least one of the upper and lower members comprises the lip portion flared away from the opposing member for increasing an entrance dimension to the slot.

12. The clip recited in claim 1, further comprising at least one nipple extending from each of the opposing surfaces, wherein the at least one nipple is proximate the lip portion.

13. The clip recited in claim 12, wherein the at least one nipple comprises a first nipple on one of the opposing surfaces and two nipples on the other opposing surface, each of the two nipples disposed on an opposite side of the first nipple, to promote deformation of and to enhance a frictional contact with an article secured therebetween.

14. A clip comprising:

a clip portion dimensioned for removably attaching to an article, wherein the clip portion comprises an upper member and a lower member having opposing surfaces defining a slot therebetween for receiving the article through a lip portion of the slot and frictionally securing the article therein;

an object mounting portion formed with the clip portion, wherein the object mounting portion includes grasping means comprising opposing segments for removably and snugly grasping objects of different width dimensions, wherein the opposing segments include at least two segment portions having different dimensions corresponding to respective dimensions of different objects, and wherein a segment of the grasping means comprises a portion of the upper member of the clip portion.

* * * * *